US006786768B2

(12) United States Patent
Murakami

(10) Patent No.: US 6,786,768 B2
(45) Date of Patent: Sep. 7, 2004

(54) ELECTRICAL CONNECTION ASSEMBLY

(75) Inventor: Takao Murakami, Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 10/077,912

(22) Filed: Feb. 20, 2002

(65) Prior Publication Data

US 2002/0146281 A1 Oct. 10, 2002

(30) Foreign Application Priority Data

Feb. 27, 2001 (JP) ..... P 2001-052464

(51) Int. Cl.[7] ..... H01R 13/40
(52) U.S. Cl. ..... 439/595; 439/271; 439/752
(58) Field of Search ..... 439/595, 752, 439/271

(56) References Cited

U.S. PATENT DOCUMENTS

| | | | | | |
|---|---|---|---|---|---|
| 4,944,688 | A | * | 7/1990 | Lundergan | 439/275 |
| 5,108,310 | A | * | 4/1992 | Sawada et al. | 439/595 |
| 5,116,236 | A | * | 5/1992 | Colleran et al. | 439/271 |
| 5,256,084 | A | * | 10/1993 | Kodama | 439/595 |
| 5,292,261 | A | * | 3/1994 | Hirano et al. | 439/752 |
| 5,575,683 | A | | 11/1996 | Saito et al. | |
| 5,607,327 | A | * | 3/1997 | Tsuji et al. | 439/752 |
| 5,643,009 | A | | 7/1997 | Dinkel et al. | |
| 5,645,453 | A | * | 7/1997 | Yamaguchi | 439/595 |
| 5,692,929 | A | * | 12/1997 | Hoffmann | 439/752 |
| 5,769,664 | A | | 6/1998 | Saito et al. | |
| 5,820,411 | A | * | 10/1998 | Okabe | 439/595 |
| 5,997,364 | A | * | 12/1999 | Matsuoka et al. | 439/752 |
| 6,276,964 | B1 | * | 8/2001 | Shinozaki | 439/595 |
| 6,290,521 | B1 | * | 9/2001 | Suzuki et al. | 439/189 |
| 6,478,620 | B1 | * | 11/2002 | Bonavita et al. | 439/595 |
| 2002/0086580 | A1 | * | 7/2002 | Kurimoto et al. | |

FOREIGN PATENT DOCUMENTS

| | | |
|---|---|---|
| EP | 0 420 010 A1 | 4/1991 |
| EP | 0 716 475 A2 | 6/1996 |
| EP | 0 918 372 A2 | 5/1999 |
| EP | 1 168 516 A2 | 1/2002 |
| EP | 1 168 519 A2 | 1/2002 |
| EP | 1 168 521 A2 | 1/2002 |
| JP | 9-106847 | 4/1997 |
| JP | 9-283203 | 10/1997 |

* cited by examiner

*Primary Examiner*—Tho D. Ta
*Assistant Examiner*—Larisa Tsukerman
(74) *Attorney, Agent, or Firm*—Finnegan, Henderson, Farabow, Garrett & Dunner, L.L.P.

(57) ABSTRACT

Provided is a connector designed for double retention of a terminal fitting, which inhibits flexure of a flexible lance retaining the terminal fitting by pushing a front holder from a temporary retention position into a full retention position. The connector includes at least any one of abutting planes of a retaining protrusion and a retention arm performing temporary retention of the front holder, as an element to strengthen retention when pushing force is applied to the front holder. Specifically, said abutting plane is formed as an inclined plane with an angle in a direction of generating bites upon application of pushing force. And the connector is designed to effectuate release of retention by means of inserting a retention release jig from a front side of the connector housing.

18 Claims, 13 Drawing Sheets

ELECTRICAL CONNECTION ASSEMBLY

BACKGROUND OF THE INVENTION

The present invention relates to a connector arranged for double retention of terminal fittings to a connector housing by use of a front holder.

Japanese Unexamined Patent Publication No. 9(1997)-106847 discloses a connector of the foregoing type as shown in FIGS. 1 to 5. A housing 1 of this connector is composed of a housing body 2 including a right-and-left pair of tubular portions 3 and 3 for housing terminal fittings 9 to which electric wires 7 and rubber plugs 8 are attached by pressure, and a front holder 5 attached to a front side of outer peripheral faces of peripheral walls of the pair of tubular portions 3 and 3. On a back side of the outer peripheral faces of the peripheral walls of the pair of tubular portions 3 and 3, an annular waterproof packing 6 is embedded. A T-shaped notch 3*a* is formed in the center of an upper front side of the peripheral wall of each tubular portion 3. Inside the notch 3*a,* provided is a flexible lance 4 for retaining the terminal fitting 9.

Upon assembly of this connector 1, a pair of retaining protrusions 5*b* and 5*b* respectively on the right and the left inside the front holder 5 are fitted into tips of long holes 3*b* provided on both sides of the peripheral wall of the tubular portions 3, whereby the front holder 5 is temporarily attached (temporarily retained) to the respective tubular portions 3 in front of flexure deformation regions of the flexible lances 4 (see FIGS. 3 and 4). In this event, each of the retaining protrusions 5*a* on both of the upper faces of the front holder 5 is striking a tip of each tubular portion 3 of the housing body 2 to prevent the front holder 5 from being pushed further inward. In other words, the front holder 5 is held in a temporary retention position owing to a state that the retaining protrusions 5*b* are fitted into the long holes 3*b,* and to a state that the retaining protrusions 5*b* are striking the tips of the tubular portions 3.

Next, the terminal fittings 9 to which the electric wires 7 and the rubber plugs 8 are attached by pressure are housed in the respective tubular portions 3 from the back side of the housing body 2, and the terminal fittings 9 are subjected to primary retention inside the respective tubular portions 3 with the flexible lances 4. Subsequently, from the above-described state, the front holder 5 is further pushed into a full retention position (see FIG. 5). Then, the respective retaining protrusions 5*a* on the both upper sides of the front holder 5 are fitted into the notches 3*a* of the respective tubular portions 3 (see FIG. 1), and an upper wall of the front holder 5 (which corresponds to a lance support) intrudes into the flexure deformation regions of the respective flexible lances 4, whereby the front holder 5 is fully attached (fully retained) to the tubular portions 3. In this way, flexure deformation of the respective flexible lances 4 is regulated, whereby the respective terminal fittings 9 are doubly retained.

Note that, in the foregoing connector, an abutting plane of the temporarily retaining protrusion 5*a* with respect to the tip of the tubular portion 3 is composed of an inclined plane having an angle $\alpha 1$ in an unlocking direction (see FIG. 2), in order to generate component force in the event that an assembly operator pushes the front holder 5 located in the temporary retention position of FIG. 4 into the full retention position of FIG. 5 by fingers.

SUMMARY OF THE INVENTION

Nevertheless, the above-described inclined plane of the temporarily retaining protrusion 5*a* is designed to generate the component force in the direction of the inclined plane to a degree pushable by fingers. Accordingly, when transportation or transfer takes place in an assembly state that the front holder 5 is temporarily retained, a problem would occur that the front holder 5 is pushed into the full retention position by a shock or dropping.

The present invention is made in consideration of the foregoing circumstance. An object of the present invention is to provide a connector arranged for preventing a front holder of the connector in a temporary retention position from being pushed into a full retention position easily.

In a first aspect of the present invention, a connector housing is composed of a housing body to which terminal fittings are inserted from a back side thereof, and a holder to be engaged with the housing body from the front side thereof. The holder is made pushable from a temporary retention position short of the housing body toward a full retention position on a back side. Between the housing body an the holder, provided are temporary retention means for temporarily retaining the holder in the temporary retention position, and full retention means for fully retaining the holder in the full retention position. On any one of the housing body and the holder, provided is a flexible lance or arm for retaining a terminal fitting inserted from a back side of the connector housing for preventing extraction, in a state that the holder is located in the temporary retention position. On the other one of the housing body and the holder, provided a lance or arm support for inhibiting the flexure of the flexible lance by intruding into a flexure allowable space of the flexible lance when the terminal fitting is pushed from the temporary retention position into the full retention position in the state that the terminal fitting is retained by the flexible lance to prevent extraction, whereby the terminal fitting is doubly retained. In a connector of the above described constitution, the temporary retention means strengthens retention when pushing force is applied to the holder. Also, the connector is characterized by a constitution that retention is released upon insertion of a retention release jig from the front side of the connector housing.

In the case of assembling this connector, firstly, the front holder is fitted into the housing body, and the front holder is temporarily retained in the temporary retention position by the temporary retention means. When pushing force acts on the front holder in this state of temporary retention, the temporary retention means acts in a direction to strengthen the retention. In other words, the front holder will be completely locked. Accordingly, temporary retention will not be released, whereby the front holder will be avoided from being pushed from the temporary retention position into the full retention position accidentally upon transportation or transfer.

In this state of temporary retention, the terminal fitting is inserted from the back side of the connector housing, and the terminal fitting is retained by the flexible lance to prevent extraction. Subsequently, while releasing temporary retention by inserting the retention release jig from the front side of the connector housing, the front holder is pushed from the temporary retention position into the full retention position. Then, the lance support intrudes into the flexure-allowable space of the flexible lance, thus inhibiting flexure of the flexible lance. By pulling out the retention release jig simultaneously with the above action, the front holder is fully retained on the housing body by the full retention means. In this way, the connector with the doubly retained terminal fitting is finished.

A second aspect of the present invention is the connector according to the above-described first aspect, in which the temporary retention means includes a retention arm provided resiliently deformable on either one of the housing body or the front holder, and a retaining protrusion to be formed on the other one of the housing body or the front holder for temporarily retaining the front holder in the temporary retention position by abutting on a tip of the retention arm. Here, the connector is characterized in that an inclination is provided at least on one of the tip of the retention arm and an abutting plane of the retaining protrusion for generating a biting action reverse to a direction to release retention when pushing force is applied to the front holder.

In this connector, when the pushing force acts on the temporarily retained front holder, bites are generated in the direction of strengthening the retention between the retention arm and the retaining protrusion because of a function of the inclined abutting plane. Accordingly, the retention arm will not be released from the retaining protrusion but a complete lock is achieved, whereby the front holder will be avoided from being pushed into the full retention position accidentally upon transportation or transfer. In order to release the state of temporary retention of this connector, the tip of the retention arm may be released from an abutting position on the retaining protrusion by deforming the tip of the retention arm with the retention release jig inserted from the front side of the connector housing.

A third aspect of the present invention is the connector according to the above-described second aspect, in which the retaining protrusion is provided on the front holder, and the retention arm is provided on the housing body in a manner that the tip, which is a free end, is directed to the front, and a jig insertion hole is provided on the front holder for inserting the retention release jib from the front side of the front holder.

In order to release temporary retention of the front holder of this connector, the retention release jig is inserted from the jig insertion hole of the front holder to release the tip from the abutting position on the retaining protrusion by deforming the tip of the retention arm toward a releasing direction, and the front holder is pushed in simultaneously. Temporary retention can be released by the foregoing operation.

A fourth aspect of the present invention is the connector according to the above-described second aspect, in which the retaining protrusion and the retention arm serve as both the temporary retention means and the full retention means, and a concave portion for engagement is provided on the retention arm for allowing the retaining protrusion to be fitted therein in order to achieve full retention.

In this connector, full retention can be achieved by releasing temporary retention owing to abutment of the tip of the retention arm and the retaining protrusion with a jig, and subsequently by fitting the retaining protrusion into the concave portion for engagement.

A fifth aspect of the present invention is the connector according to the above-described fourth aspect, in which an engaging protrusion is provided, aside from the foregoing retaining protrusion, for preventing extraction toward the front side of the front holder upon temporary retention of the front holder by fitting into the concave portion for engagement provided on the retention arm.

In this connector, the front holder can be securely held not to jolt back and forth upon temporary retention thereof by functions of the retaining protrusion, the engaging protrusion and the retention arm.

A sixth aspect of the present invention is the connector according to the above-described first aspect, in which a waterproof plug is provided between a terminal insertion hole formed on the housing body and an electric wire extending backward from the terminal fitting, for sealing a gap between the terminal insertion hole and the electric wire, and a packing is provided on the housing body for sealing a gap between the connector and a housing of an opponent connector when the connector is fitted into the opponent connector. The connector is characterized by a waterproof constitution owing to sealing functions of the waterproof plug and the packing.

In the waterproof connector sealing an electric wire outgoing portion with the waterproof plug and sealing a connector fitting portion with the packing, the problem is where a holder for double retention of a terminal fitting is to be attached from. However, since the connector of the present invention adopts a mode of attaching a holder (the front holder) from the front thereof, the connector can adopt a compact constitution while maintaining a waterproof structure.

A seventh aspect of the present invention is the connector according to the above-described first aspect, in which a terminal housing chamber is provided on the front holder and the flexible lance is provided on a wall of the terminal housing chamber, and the lance support is provided on the housing body.

In this connector, the terminal fitting inserted from the back side of the connector housing is housed in the terminal housing chamber of the front holder temporarily retained on the housing body. For this reason, the terminal fitting can be subjected to primary retention by the flexible lance. Moreover, the terminal fitting moves together with the front holder when the front holder is moved from the temporary retention position to the full retention position in a state that the terminal fitting is retained. For this reason, it is possible to confirm as to whether a pushing operation to the full retention position of the front holder is surely performed, by visually confirming a position of the terminal fitting or a position of the electric wire extending backward from the terminal fitting.

DESCRIPTION OF THE PREFERRED EMBODIMENT

Now, one embodiment of the present invention will be described based on FIGS. 6 to 15.

Figure 1:
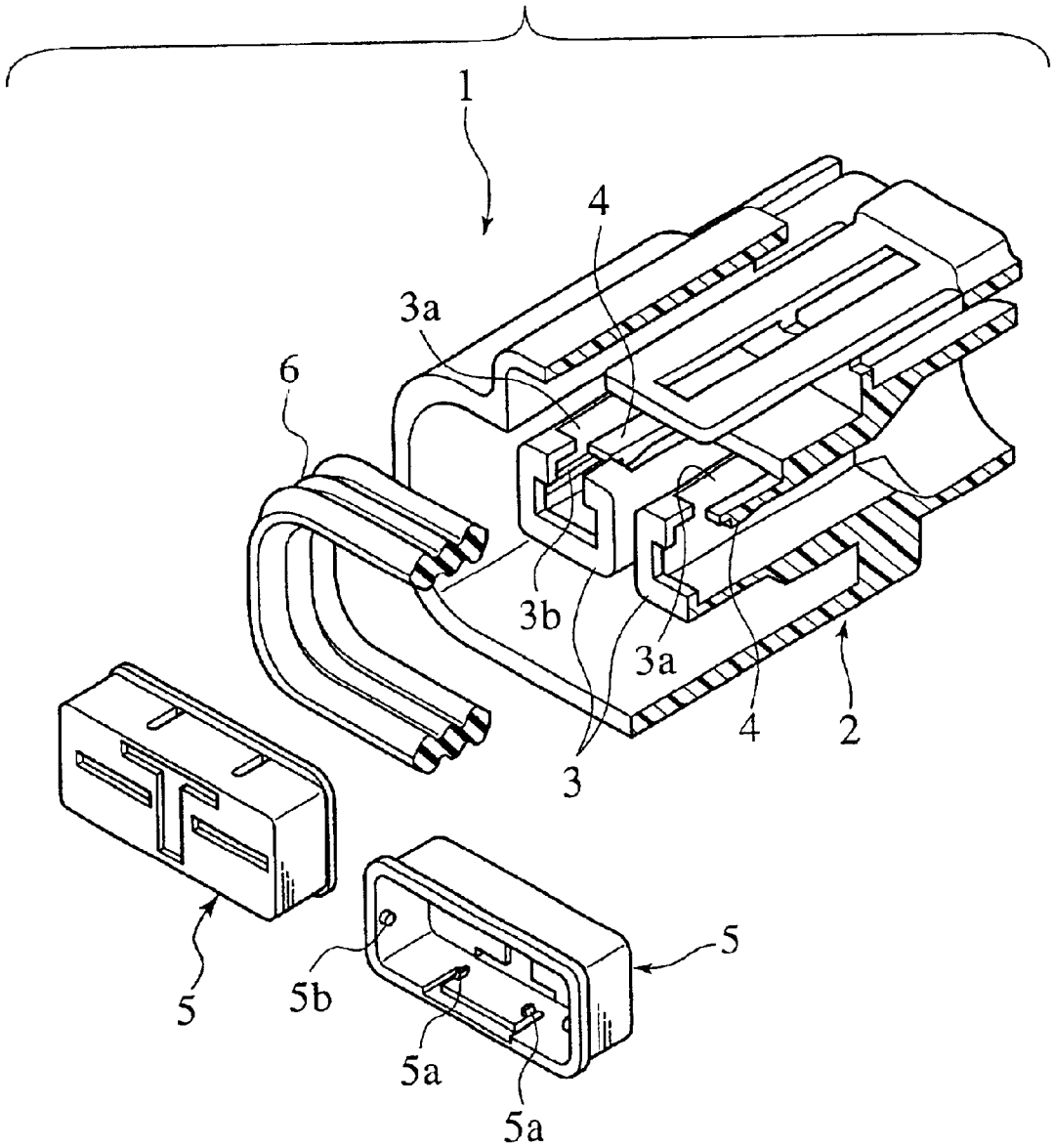
FIG. 1 is a perspective view showing a related connector in a state before assembly.
Figure 2:
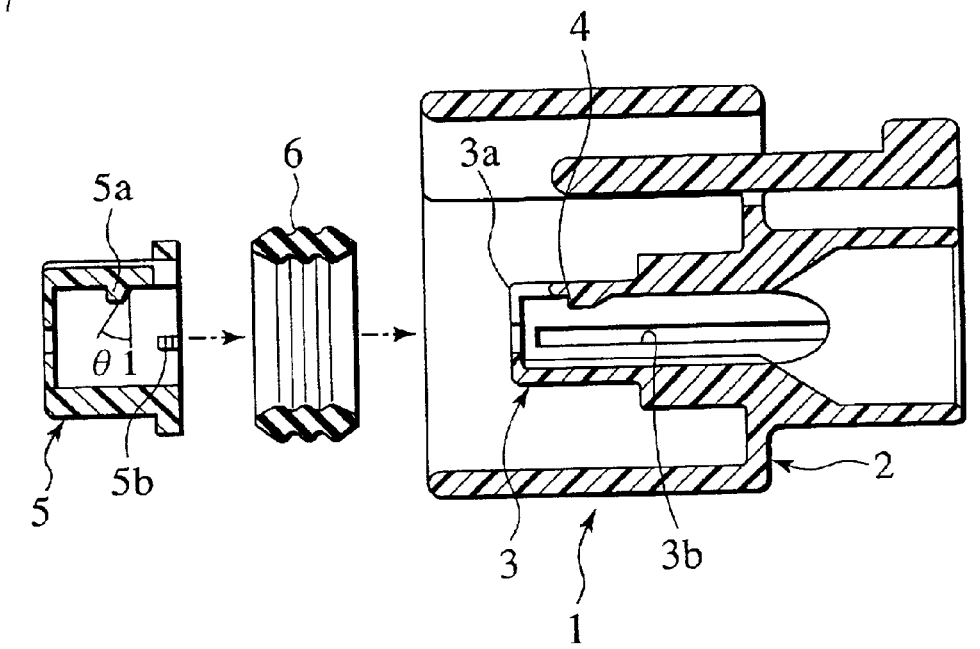
FIG. 2 is a longitudinal sectional view showing the related connector in the state before assembly.
Figure 3:
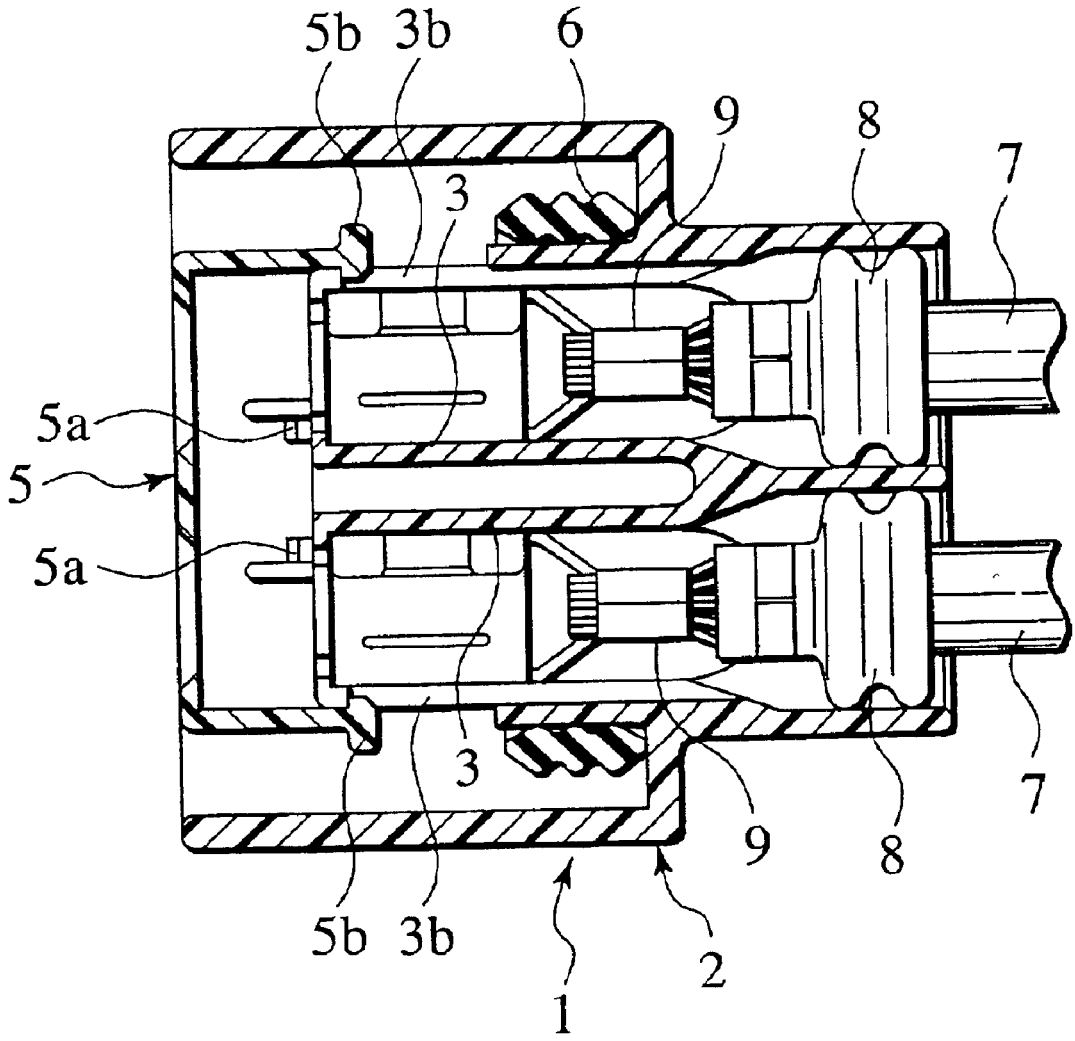
FIG. 3 is a transverse sectional view of a front holder of the related connector in a state of temporary attachment thereof to a housing body.
Figure 4:
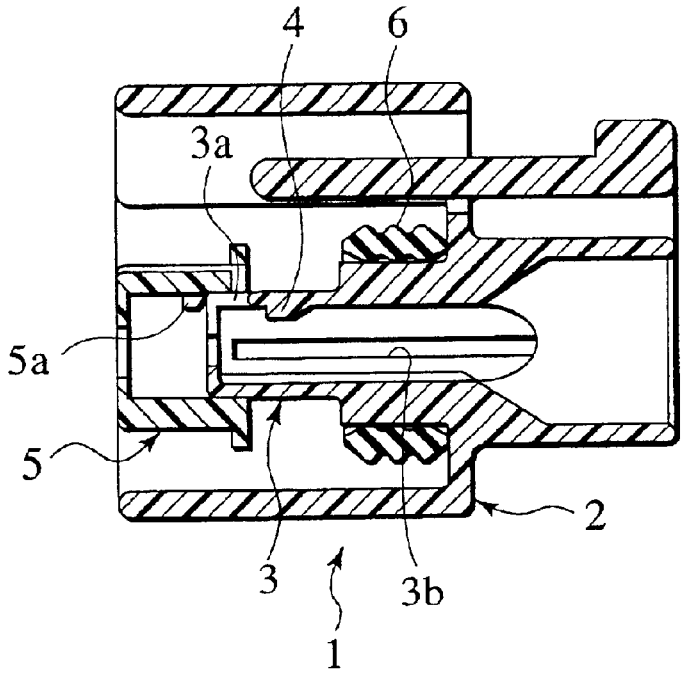
FIG. 4 is a longitudinal sectional view of the front holder of the related connector in the state of temporary attachment thereof to the housing body.
Figure 5:
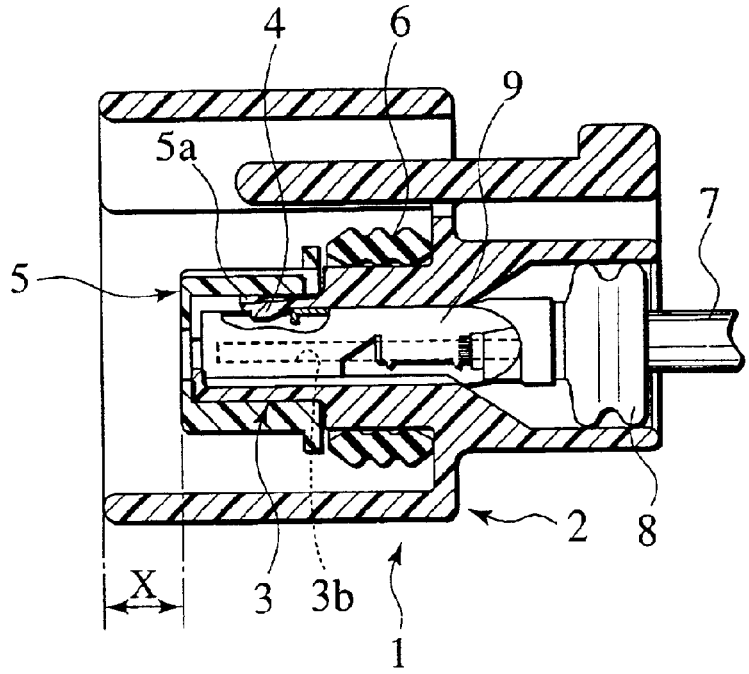
FIG. 5 is a longitudinal sectional view of the front holder of the related connector in a state of assembly completion by full attachment thereof to the housing body.
Figure 6:
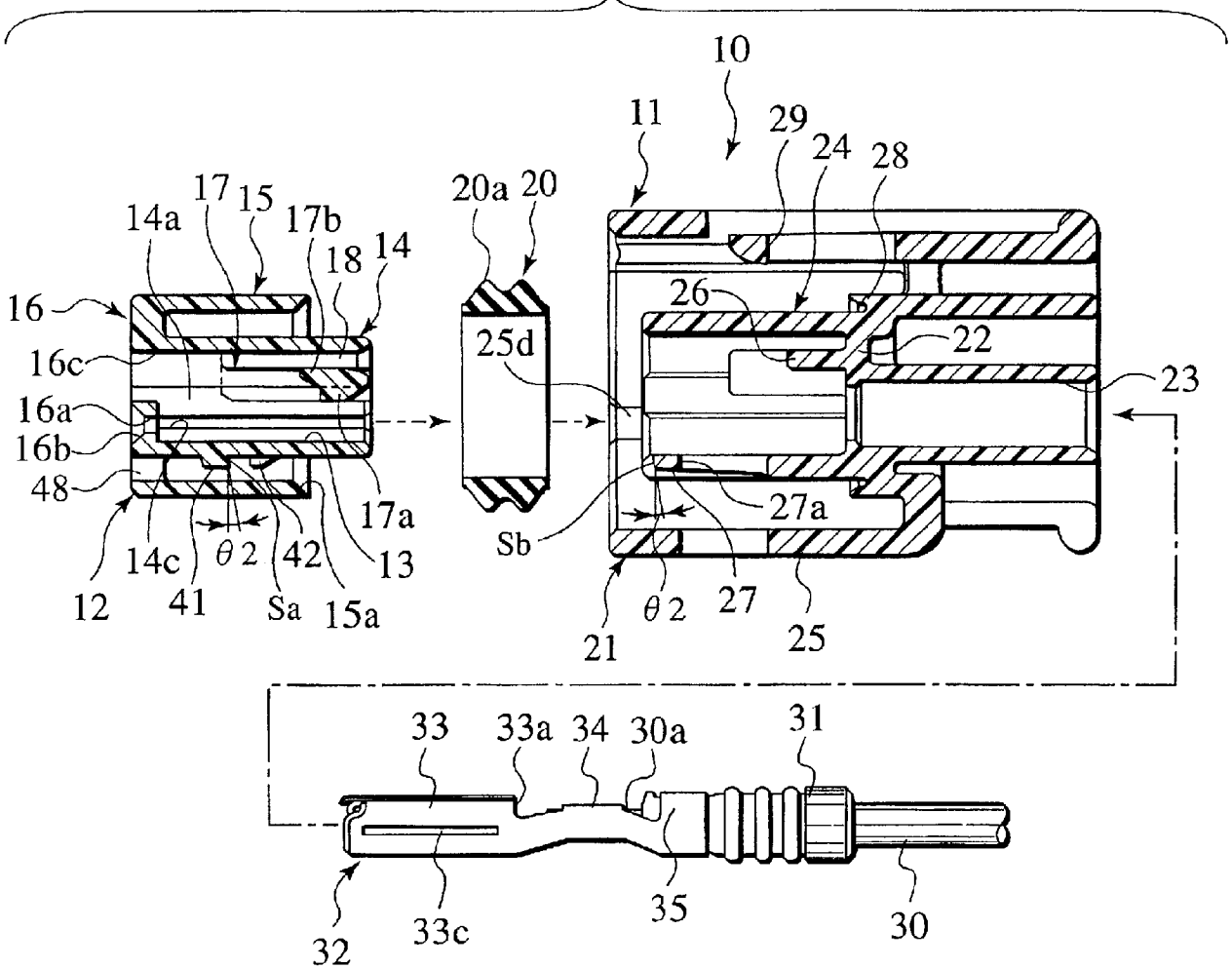
FIG. 6 is a longitudinal sectional view showing a connector according to an embodiment of the present invention in a state before assembly.
Figure 7:
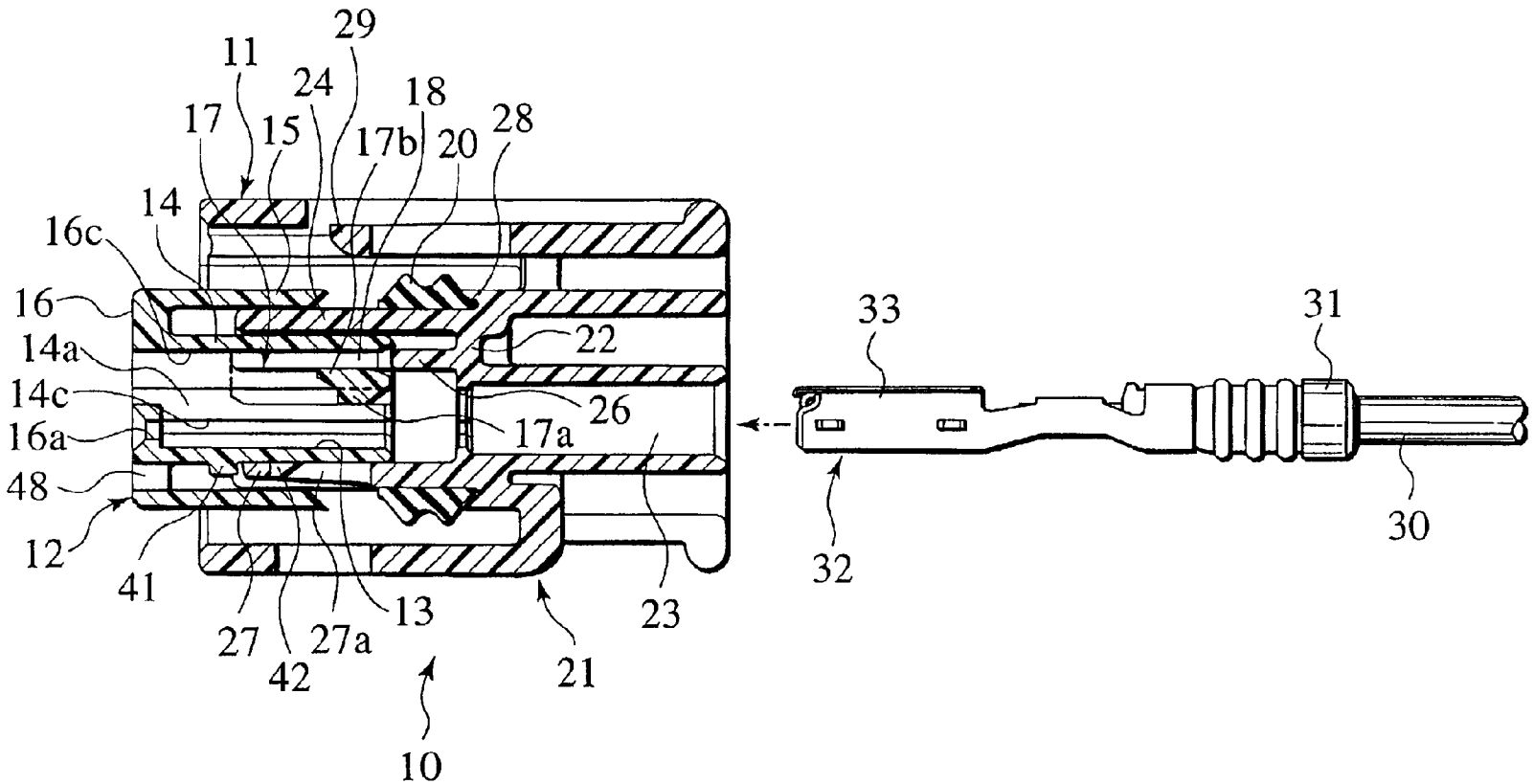
FIG. 7 is a longitudinal sectional view showing a state before insertion of a terminal fitting in a state that a front holder of the connector is temporarily set on a housing body.
Figure 8A:
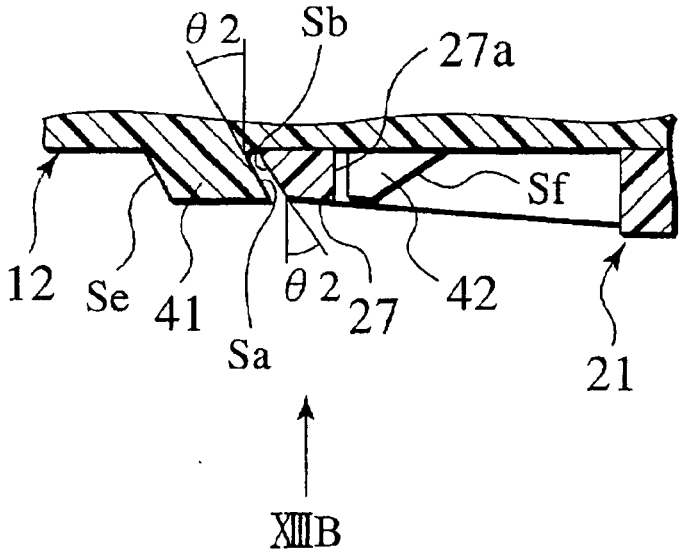
FIG. 8A is a partially enlarged view of FIG. 7.
Figure 8B:
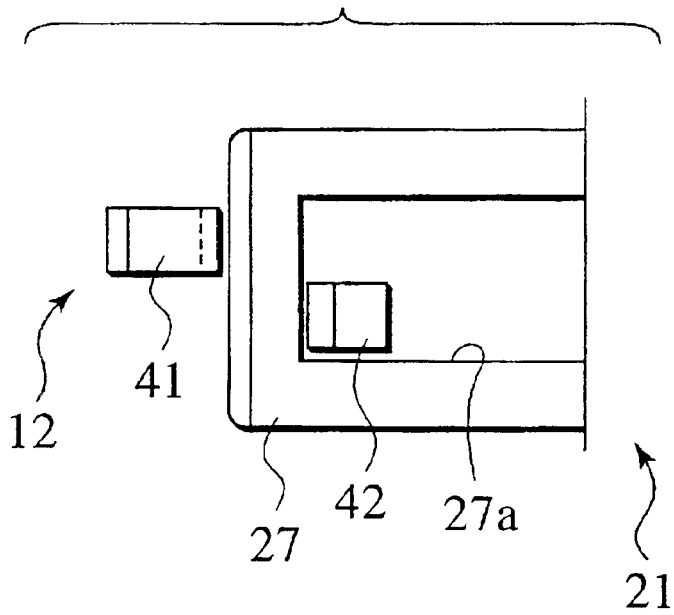
FIG. 8B is a plan view of 8A viewed from a direction as indicated with an arrow VIII B.
Figure 9:
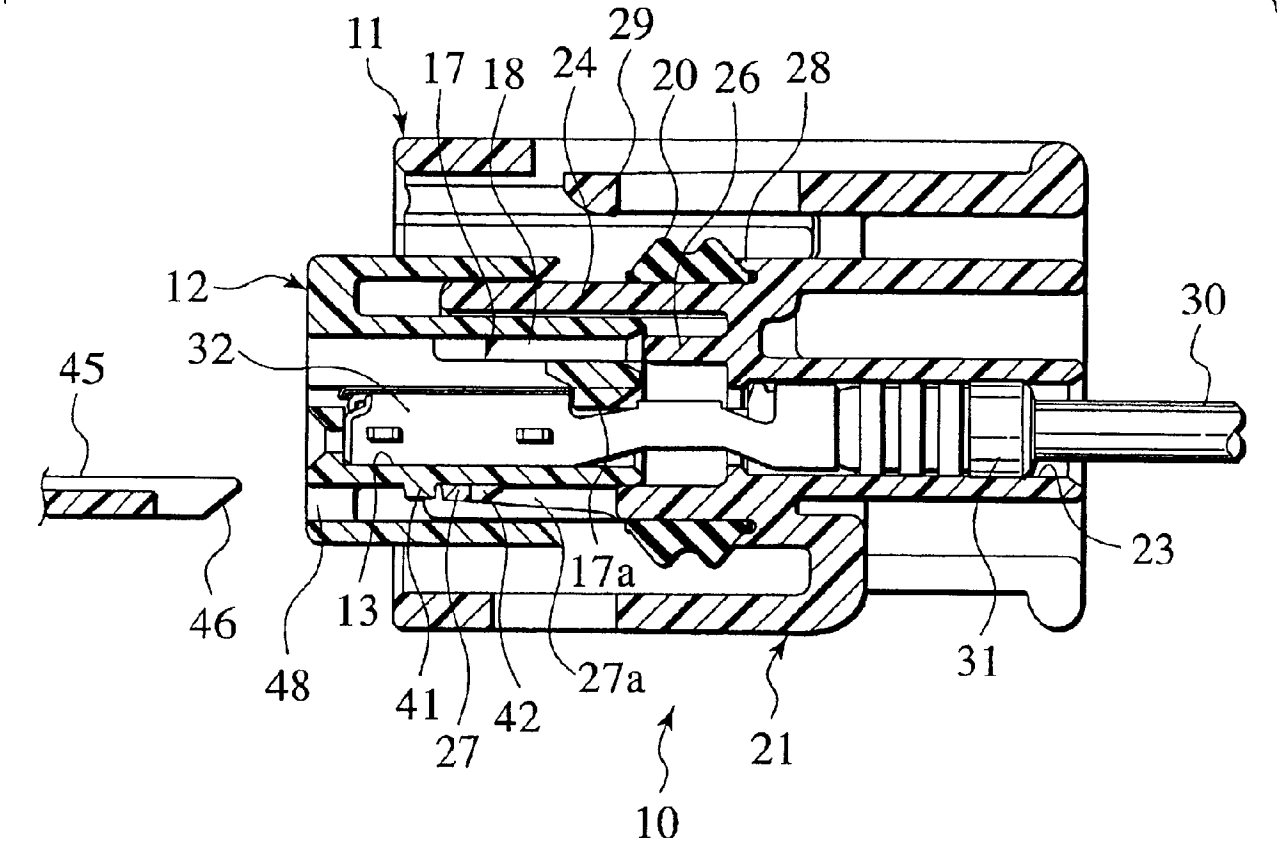
FIG. 9 is a longitudinal sectional view showing a state that the terminal fitting is further inserted in the state as shown in FIG. 7.
Figure 10:
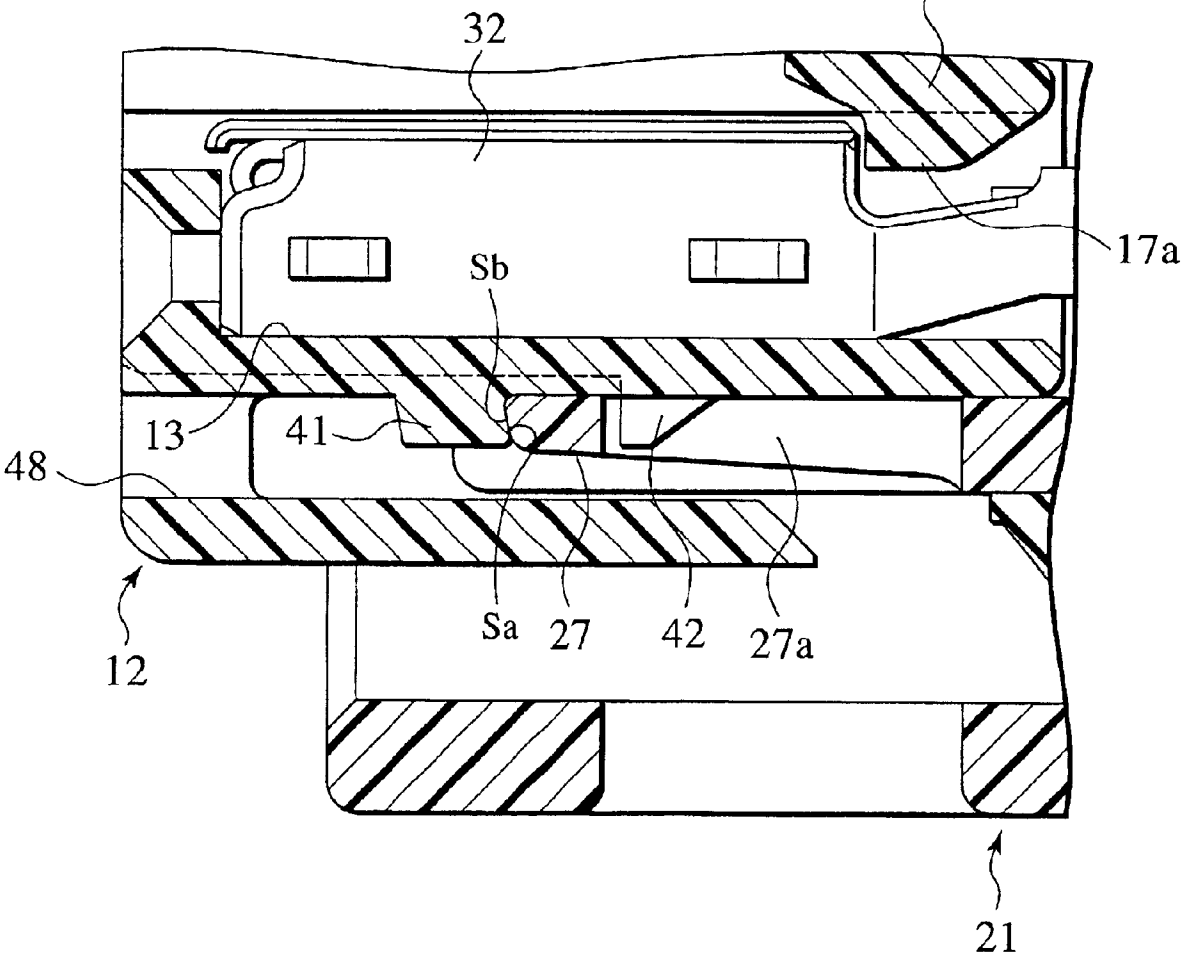
FIG. 10 is a partially enlarged view of FIG. 9.
Figure 11:
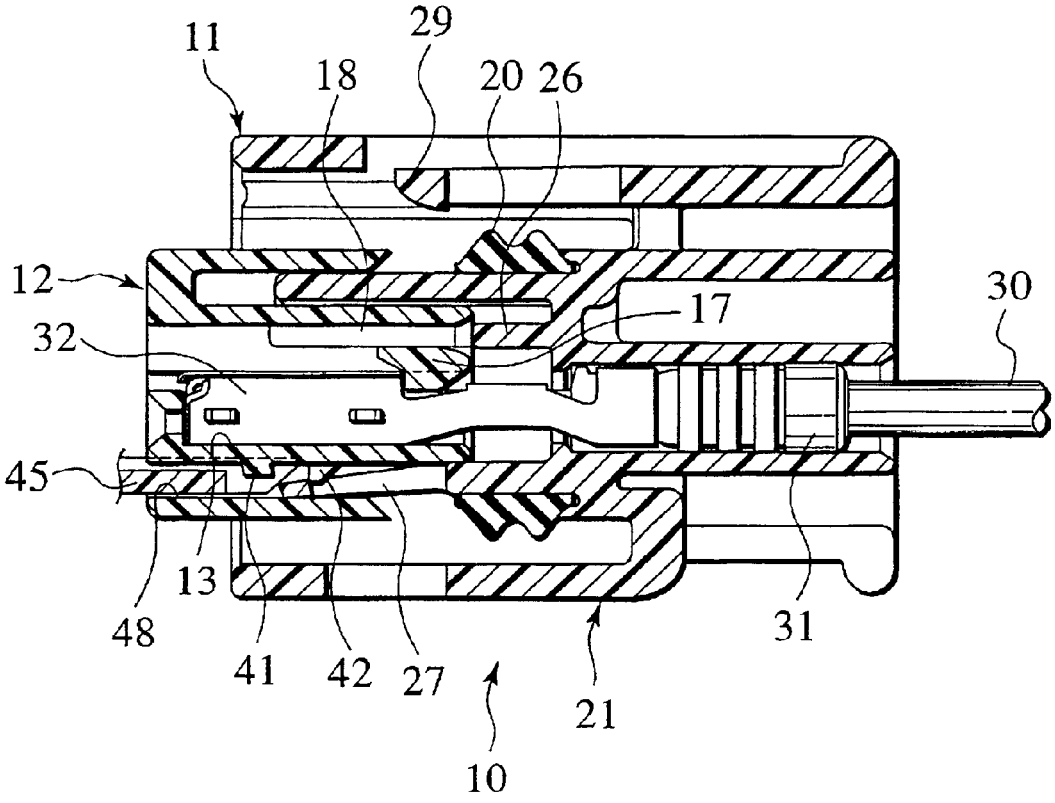
FIG. 11 is a longitudinal sectional view showing a state that temporary retention is being released by insertion of a retention release jig in the state as shown in FIG. 9.
Figure 12:
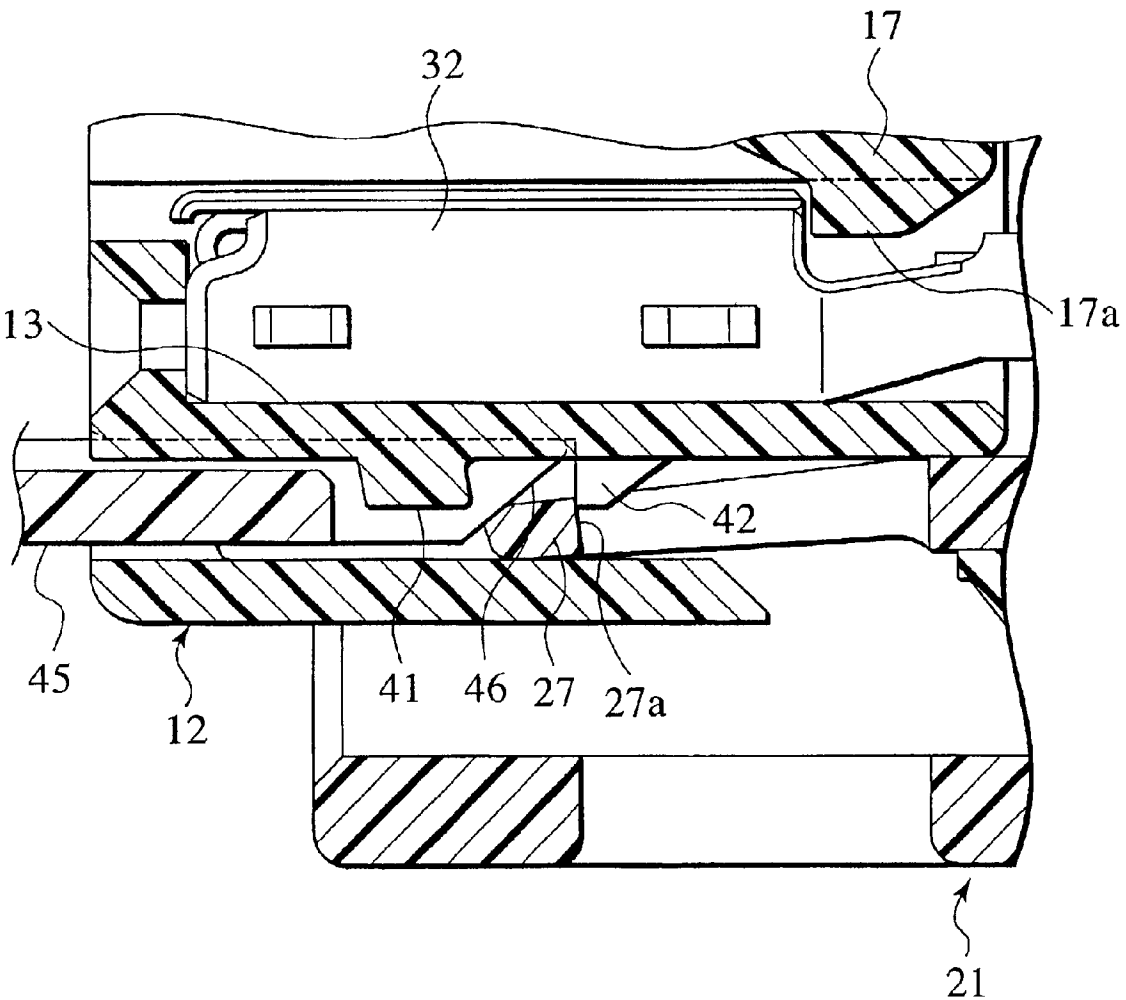
FIG. 12 is a partially enlarged view of FIG. 11.
Figure 13:
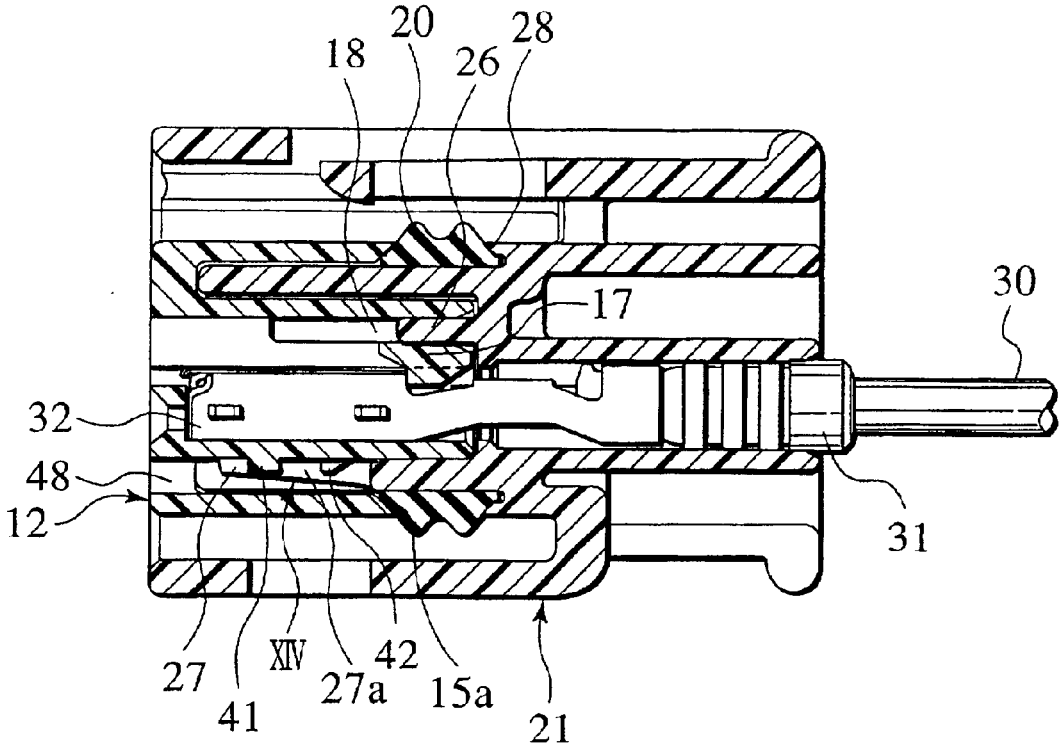
FIG. 13 is a longitudinal sectional view showing a state of full fitting by pushing the front holder from the state as shown in FIG. 11.
Figure 14:
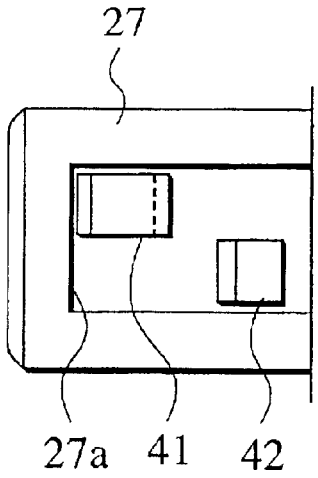
FIG. 14 is an enlarged view of FIG. 13 viewed from under a XIV portion thereof.
Figure 15:
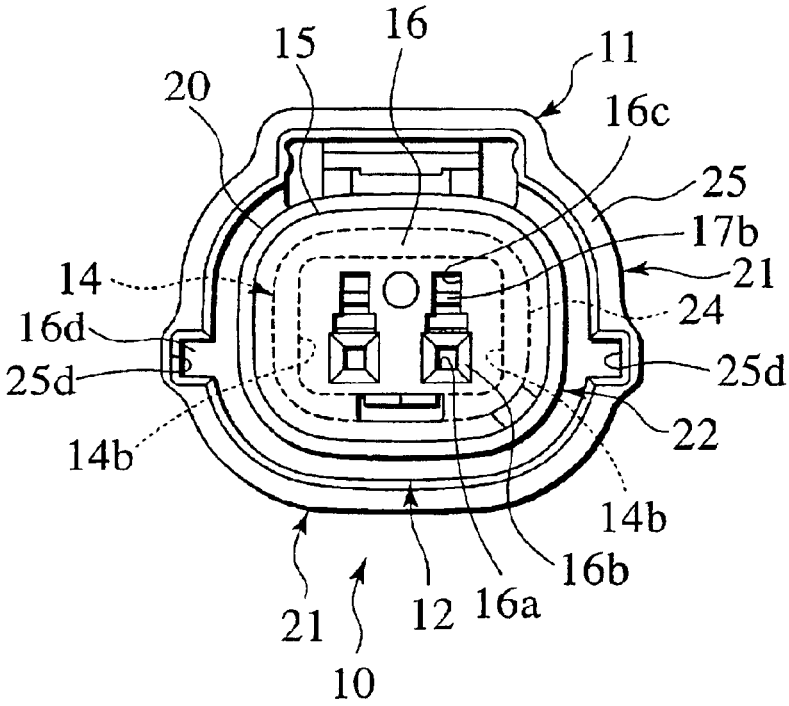
FIG. 15 is a front elevation of FIG. 13.

FIG. 6 is a longitudinal sectional view showing a waterproof connector (a connector) according to one embodiment of the present invention in a state before assembly. FIG. 7 is a longitudinal view showing a state before insertion of a terminal fitting in a state that a front holder of the connector is temporarily fitted (temporarily retained) into a housing body. FIG. 8A is a partially enlarged view of FIG. 7. FIG. 8B is a plan view of 8A viewed from a direction as indicated with an arrow VIII B. FIG. 9 is a longitudinal sectional view showing a state of the terminal fitting subjected to insertion and primary retention in the state of temporary fitting. FIG. 10 is a partially enlarged view of FIG. 9. FIG. 11 is a longitudinal sectional view showing a state that temporary retention is being released by insertion of a retention release jig. FIG. 12 is a partially enlarged view of FIG. 11. FIG. 13 is a longitudinal sectional view showing a state of assembly completion of the connector in which the terminal fitting is subjected to double retention by fully fitting (fully retaining) the front holder into the housing body. FIG. 14 is a view of FIG. 13 viewed from under a XIV arrow portion. FIG. 15 is a front elevation of the connector in the state of assembly completion.

As shown in these drawings, a housing 11 of a connector 10 is composed of a plastic front holder 12 in which a right-and-left pair of terminal housing chambers 13 and 13 are formed integrally, each of which is provided for housing a terminal fitting 32 to which an electric wire 30 and a rubber plug 31 are attached by pressure, and a plastic housing body 21 in which a right-and-left pair of terminal insertion portions (terminal insertion holes) 23 and 23 of approximately circular tubes are formed integrally, each of which is provided for allowing the front holder 12 to be fitted inside and allowing the electric wire 30, the rubber plug 31 and the terminal fitting 32 to be inserted. A waterproof packing 20 is interposed between the front holder 12 and the housing body 21 for sealing a gap between the connector and a housing of an opponent connector when such an opponent connector is fitted in. Here, the front holder 12 is fitted into the housing body 21 from a front side with respect to the housing body 21, and the terminal fitting 32 is inserted from the back side of the housing body 21. Moreover, the packing 20 is designed to be attached from the front side of the housing body 21.

The front holder 12 includes an inner peripheral wall portion (a peripheral portion) 14 of an approximately rectangular tube having an opening on the back side thereof, which is fitted into a inner peripheral face side of an inner peripheral wall portion 24 of the housing body 21, an outer peripheral wall portion (a peripheral portion) 15 of an approximately rectangular tube extending backward so as to cover around the inner peripheral wall portion 14, which is fitted into an outer peripheral face side of the inner peripheral wall portion 24 of the housing body 21, and a front wall portion 16 which forms the inner and the outer peripheral wall portions 14 and 15 integrally in the back side thereof. And the pair of the terminal housing chambers 13 and 13 are formed on the right and the left sides of a partition wall 14*a* as a border, the partition wall 14*a* also serving as a sidewall in the center of the inner peripheral wall portion 14.

On an upper side inside the inner peripheral wall portion 14 of each terminal housing chamber 13 of the front holder 12, a flexible lance (a flexible retention arm) 17 for retaining the terminal fitting 32 housed in each terminal housing chamber 13 is integrally formed as a protrusion so as to extend from the front side toward the back side. On a lower portion of a free end side of each of the flexible lances 17, a retaining protrusion 17*a* is integrally formed as a protrusion to be engaged with a retaining portion 33*a* of the terminal fitting 32. Moreover, on the rear of the free end side, a releasing protrusion 17*b* is integrally formed as a protrusion. Furthermore, a flexure-allowable space 18 for the flexible lance 17 is formed between an upper wall side of the inner peripheral portion 14 and each of the flexible lances 17.

In addition, in the center of each of the both sidewalls 14*a* and 14*b* of the inner peripheral wall portion 14 constituting the respective terminal housing chambers 13, a groove 14*c* of a concave section as a positioning guide is integrally formed to extend horizontally.

Moreover, on a lower back side of the outer peripheral face of the inner peripheral wall portion 14 of the front holder 12, provided are a retaining protrusion 41 and an engaging protrusion 42 for temporarily retaining as well as fully retaining the front holder 12 with respect to the housing body 21. FIG. 7 to FIG. 10 show a state that the front holder 12 is in a temporary retention position, and FIG. 13 and FIG. 14 show a state that the front holder 12 is in a full retention position. As shown in these drawings, the front holder 12 is made pushable with respect to the housing body 21, from the temporary retention position at the front side toward the full retention position at the back side.

As shown in FIG. 7 to FIG. 10, the retaining protrusion 41 inhibits movement of the front holder 12 toward a pushing direction (to the back side) by abutting on a tip of a retention arm 27 provided on the inner peripheral wall portion 24 of the housing body 21, whereby the retaining protrusion 41 functions to hold the front holder 12 in the temporary retention position. Moreover, when the front holder 12 is located in the full retention position as shown in FIG. 13 and FIG. 14, the retaining protrusion 41 inhibits movement of the front holder 12 toward an extracting direction (to the front side) by fitting into an engaging hole 27*a* of the retention arm 27, whereby the retaining protrusion 41 functions to hold the front holder in the full retention position. Meanwhile, when the front holder 12 is located in the temporary retention position, the engaging protrusion 42, which is disposed in the back side of the retaining protrusion 41 with an interval, inhibits extraction of the front holder 12 toward the front side by fitting into the engaging hole 27*a* of the retention arm 27, whereby the engaging protrusion 42 functions to hold the front holder 12 in the temporary retention position.

Therefore, the retaining protrusion 41, the engaging protrusion 42 and the retention arm 27 including the engaging hole 27*a* collectively constitute temporary retention means as well as full retention means.

Moreover, an insertion hole 48 for a retention release jig 45 is provided for releasing temporary retention and full retention of the retention arm 27 with the retaining protrusion 41 as well as the engaging protrusion 42, in a location between the inner peripheral wall portion 14 and the outer peripheral wall portion 15 of the front holder 12. The retention release jig 45 is a bar having an inclination 46 on a tip thereof, which is designed to be capable of flexing the tip of the retention arm 27 toward a retention releasing direction by inserting the tip of the retention release jig 45 from the insertion hole 48.

Here, on abutting planes Sa and Sb of the retaining protrusion 41 and the retention arm 27, provided are inclined planes by an angle $\theta 2$ in a direction reverse to a direction to release retention, as shown in FIG. 6, FIG. 8A and FIG. 8B. These inclined planes generate a biting action in the direction not to release retention when pushing force is applied to the front holder 12. Therefore, it is necessary to use the above-described retention release jig 45 (or any tools having equivalent functions) in order to release retention. Moreover, as shown in FIGS. 8A and 8B, a plane Se opposite with the abutting plane Sa (i.e. the plane on the front side) of the retaining protrusion 41 is inclined in order to facilitate releasing of full retention owing to the retention arm 27 and the retaining protrusion 41 in the case of attempting to release the front holder 12 from the housing body 21. Furthermore, a front plane Sf of the engaging protrusion 42 is inclined in order that the tip of the retention arm 27 can overpass the engaging protrusion 42 easily upon fitting the front holder 12 into the housing body 21.

The flexible lance 17 is made flexible in the foregoing state of temporary retention of the front holder 12, which is designed as capable of retaining the terminal fitting 32 to be inserted into the terminal housing chamber 13 through the terminal insertion portion 23 to prevent extraction in the state of temporary retention (a state of temporary fitting). Moreover, in the state of temporary retention, the side of the front wall portion 16 of the front holder is designed to protrude by a predetermined length toward the front side of the housing body 21.

Furthermore, the rubber plug 31 attached to a waterproof plug caulking 35 on the rear end of the terminal fitting 32 constitutes a marker for confirming an operation for full retention of the front holder 12. The rubber plug (the marker) 31 becomes visible from outside when the front holder 12 is moved from the temporary retention position to the full retention position.

A tip 15*a* of the outer peripheral wall portion 15 of the front holder 12 is formed into an inverted cone shape, whereby the waterproof packing 20 can be held in a state of close contact between the tip 15*a* of the outer peripheral wall portion 15 of the front holder 12 and a packing receiver 28 of the inner peripheral wall portion 24 of the housing body 21.

In positions facing the respective terminal housing chambers 13 of the front wall portion 16 of the front holder 12, formed severally are terminal penetration holes 16*a* that allow penetration of terminal fittings of an opponent connector which is not illustrated herein. A tapered guide plane 16*b* is formed around a front face side of each of the terminal penetration holes 16*a*. Moreover, on an upper side of each of the terminal penetration holes 16*a* of the front wall portion 16 of the front holder 12, formed is a jig insertion hole 16*c* for inserting an unillustrated bar-shaped terminal extraction jig.

Moreover, when a tip of the terminal extraction jig is inserted into the jig insertion hole 16*c* in the same direction to be the direction of inserting an opponent terminal fitting, the tip of the terminal extraction jig is designed as capable of moving the retaining protrusion 17*a* upward by hitting the inclined plane of the releasing protrusion 17*b* of the flexible lance 17. That is, the releasing protrusion 17*b* of the flexible lance 17 is pressed with the tip of the terminal extraction jig inserted from the jig insertion hole 16*c* in the state of temporary retention of the front holder 12 and the housing body 21, whereby the retaining protrusion 17*a* of the flexible lance 17 is deformed in the direction deviating from the retaining portion 33*a* of the terminal fitting 32 within the flexure-allowable space 18.

The waterproof packing (an elastic body) 20 is annularly formed with a rubber member, and dancette convex portions 20*a* are integrally formed back and forth on an outer peripheral face side of the waterproof packing 20.

These convex portions 20*a* formed back and forth are designed to facilitate close contact between the tip 15*a* of the outer peripheral wall portion 15 of the front holder 12 and the packing receiver 28 of the inner peripheral wall portion 24 of the housing body 21.

Meanwhile, the housing body 21 constitutes a double structure with openings provided respectively on the front side and the back side thereof, by the right-and-left pair of the terminal insertion portions 23 of approximately circular tubes integrally formed as protrusions backward from the boarder of the central partition wall 22, the inner peripheral wall portion (the peripheral wall portion) 24 of an approximately rectangular tube integrally formed as a protrusion forward from the partition wall 22 which serves also as the terminal insertion portion that communicates with each of the terminal insertion portions 23, and the outer peripheral wall portion (the peripheral wall portion) 25 of an approximately rectangular tube covering the inner peripheral wall portion 24. The rubber plug (the waterproof plug) 31 as the marker is housed inside each of the terminal insertion portions 23 by forcible insertion or the like, in which the rubber plug is attached to the terminal fitting 32 by pressure and is fitted into the electric wire 30 without gaps. That is, the rubber plug 31 attached to the terminal fitting 32 side of the electric wire 30 is designed to be housed in a state of close contact between the electric wire 30 and the terminal insertion portion 23 of an approximately circular tube upon the full fitting of the front holder 12.

Moreover, in a position of the partition wall 22 inside the inner peripheral wall portion 24 of the housing body 21 facing the flexure-allowable space 18 of the flexible lance 17 of the front holder 21, a flexure inhibitor (a lance support) 26 of a plate shape is integrally formed as a protrusion. This flexure inhibitor 26 is provided for inhibiting flexure deformation of the flexible lance 17 by intrusion into the flexure-allowable space 18 upon the full fitting of the front holder 12 and the housing body 21.

In addition, on a lower side of the inner peripheral wall portion 24 of the housing body 21, provided is the above-described retention arm 27 including the rectangular engaging hole 27 to be engaged and disengaged with the retaining protrusion 41 and the engaging protrusion 42 of the inner peripheral wall portion 14 of the front holder 12. Moreover, on a partition wall 22 side of a base end of the inner peripheral wall portion 24 of the housing body 21, the V-shaped packing receiver 28 is integrally formed as a protrusion for receiving the annular waterproof packing 20 made of rubber.

Note that a concave portion 25*d* for guiding convex portions provided on both sides of an unillustrated opponent housing is formed severally in the center of each of both inner faces of the outer peripheral wall portions 25 of the housing body 21. Moreover, in the front side of the upper wall of the outer peripheral wall portion 25 of the housing body 21, formed is a retaining hole (a retaining portion) 29 with which an unillustrated flexible retention arm of the opponent connector is engaged or disengaged.

Moreover, as shown in FIG. 6 and FIG. 7, a terminal body 33 of the terminal fitting 32 has a female shape of a rectangular tube, and in the approximate center on both sides thereof, convex portions 33*c* as positioning portions are integrally formed as protrusions so as to extend to a horizontal direction. These convex portions 33*c* are designed to perform positioning of the terminal fitting 32 inside the respective terminal housing chambers 13 by being engaged with the concave grooves 14*c* on the both sides of each of the terminal housing chambers 13. Moreover, upon housing, an upper end 33*a* of a trailing edge as a retaining portion of the terminal body 33 is designed to be retained by the retaining protrusion 17*a* of the flexible lance 17. Note that a core wire 30*a* of the electric wire 30 is attached to a core wire caulking 34 of the terminal fitting 32 with caulking by pressure, and a front end of the rubber plug 31 is also attached to a waterproof plug caulking 35 of the terminal fitting 32 with caulking by pressure.

Next, description will be made regarding an operation for a case of assembling the connector 10 of the above-described constitution.

When the connector 10 is assembled, as shown in FIG. 7, the waterproof packing 20 is firstly set by fitting the waterproof packing 20 into the packing receiver 28 of the inner peripheral wall portion 24 of the housing body 21 that constitutes an exterior of the connector housing 11.

Next, the inner wall portion 14 of the front holder 12 constituting an interior of the connector housing 11 is fitted into the inner peripheral wall portion 24 of the housing body 21 to effectuate temporary retention. In other words, as shown in FIGS. 8A and 8B in magnified forms, by fitting the engaging protrusion 42 of the front holder 12 with the engaging hole 27*a* of the retention arm 27 of the housing body 21, the abutting planes Sa and Sb on the tip of the retention arm 27 on the housing body 21 side and the retaining protrusion 41 on the front holder 12 side are held in a state capable of abutting on each other. In this case, since the tip of the retention arm 27 is wedged between the retaining protrusion 41 and the engaging protrusion 42, the front holder 12 is held so as not to jolt back and forth.

In the case where pushing force is applied to the front holder 12 in this state of temporary retention, bites in the direction of strengthening the retention are generated between the retention arm 27 and the retaining protrusion 41 by actions of the inclined abutting planes Sa and Sb. Accordingly, the retention arm 27 does not have a risk of overpassing the retaining protrusion 41, and a complete lock is thereby achieved. Therefore, a problem that the front holder 12 assembled in the temporary retention position is accidentally pushed into the full retention position upon transportation or transfer is eliminated.

In such a state of temporary retention, the front wall portion 16 of the front holder 12 protrudes toward the front side of the housing body 21 by a predetermined length.

In this state, as shown in FIG. 9, the terminal fitting 32 to which the electric wire 30 and the rubber plug 31 are attached by pressure is inserted into each of the terminal insertion portions 23 of the housing body 21 from the back side thereof, whereby the terminal fitting 32 is housed inside each of the terminal housing chambers 13 of the front holder 12. In this way, the upper end 33*a* of the trailing edge of the terminal body 33 of the terminal fitting 32 is retained on the retaining protrusion 17*a* of the flexible lance 17, whereby the terminal fitting 32 is prevented from extraction.

Next, the front holder 12 will be pushed into the full retention position. However, as shown in FIG. 10, since the retention arm 27 and the retaining protrusion 41 are locked in the state of temporary retention, the front holder 12 cannot be pushed further inward. Accordingly, as shown in FIG. 11 and FIG. 12, the retention release jig 45 is inserted from the jig insertion hole 48 of the front holder 12 in order to release the state of temporary retention, and the tip of the retention arm 27 is flexed to a releasing direction to deviate from a position of abutment on the retaining protrusion 41. Then, the front holder 12 is pushed in while performing the above-described operation, thus releasing the state of temporary retention.

Moreover, simultaneously with the foregoing operation, the retention release jig 45 is extracted out of the front holder 12. Then, as shown in FIG. 13 and FIG. 14, the tip of the retention arm 27 restitutes in a position beyond the retaining protrusion 41 and the engaging hole 27*a* of the retention arm 27 is fitted into the retaining protrusion 41, whereby the front holder 12 is fully retained in the full retention position.

In this event, the flexure inhibitor 26 intrudes into the flexure-allowable space 18 of the flexible lance 17 and inhibits flexure of the flexible lance 17. In this way, the terminal fitting 32 is surely subjected to double retention, by retention owing to the retaining protrusion 17*a* of the flexible lance 17 and by indirect retention owing to the flexure inhibitor 26 inhibiting flexure deformation of the flexible lance 17.

In such a state of assembly completion, along movement of the front holder 12 from the temporary retention position to the full retention position, the rubber plug 31 on a back end of the terminal fitting 32 is slightly exposed from a back end of the housing body 21. Accordingly, it is possible to confirm as to whether a pushing operation of the front holder 12 to the full retention position is surely performed, by visually confirming such exposure.

Moreover, upon full fitting of the front holder 12 and the housing body 21, the waterproof packing 20 is closely contacted with the packing receiver 28 owing to the inclined plane of the tip 15*a* of the outer peripheral wall portion 15 of the front holder 12. Furthermore, upon such full fitting, the rubber plug 31 attached to the terminal fitting 32 side of the electric wire 30 is housed inside the terminal insertion portion 23 of the housing body 21 in a state of close contact. Accordingly, waterproof properties of the entire connector 10 after assembly completion are further enhanced.

It should be noted that the both abutting planes Sa and Sb of the retaining protrusion 41 and the retention arm 27 are inclined in the foregoing embodiment. However, the inclined plane may be provided only on the retaining protrusion 41. In the foregoing case, the tip of the retention arm 27 should be designed to hit the inclined plane. Meanwhile, it is not always necessary that the abutting planes Sa and Sb have inclinations so far as a retention state is securely maintained. In such a case, the abutting planes Sa and Sb may be composed of orthogonal planes to the direction of pushing force with respect to the front holder 12.

Moreover, in the foregoing embodiment, an attempt is made to simplify the constitution by allowing the retention arm 27 and the retaining protrusion 41 to serve both as the temporary retention means and as the full retention means. However, the full retention means may be provided otherwise.

Furthermore, in the foregoing embodiment, the retention arm 27 is provided on the housing body 21 side, and in the meantime, the retaining protrusion 41 and the engaging protrusion 42 are provided on the front holder 12 side. However, to the contrary, it is also possible to provide the retention arm on the front holder 12 side, and the retaining protrusion and the engaging protrusion on the housing body side.

Moreover, in the foregoing embodiment, the flexible lance 17 is provided by forming the terminal housing chamber 13 on the front holder 12 side. However, the flexible lance may be provided by forming the terminal housing chamber on the housing body 21 side. In this case, a flexure presser (the lance support) will be provided on the front holder side.

Furthermore, in the foregoing embodiment, the present invention has been described based on an example of application to a waterproof connector. However, the present invention will not be limited to waterproof connectors, so far as the present invention is applied to a connector of a type which doubly retains a terminal fitting by use of a front holder.

What is claimed is:

1. An electrical connection assembly, comprising:

a housing body having a front side and a back side, the housing body adapted to receive a terminal fitting from the back side;

a holder adapted to engage the housing body from the front side, the holder having a temporary retention position relative to the housing body and a full retention position relative to the housing body;

a retention arm provided on one of the housing body and the holder, the retention arm having a end portion;

a temporary retention means for engaging the retention arm to retain the holder in the temporary retention position;

a full retention means for engaging the retention arm and prohibiting the holder from moving to the full retention position, wherein the full retention means includes a surface portion configured to abut a surface portion of the end portion so as to form orthogonal abutting surfaces; and a flexible arm provided on one of the housing body and the holder, the flexible arm adapted to engage the terminal fitting.

2. An electrical connection assembly, comprising:

a housing body having a front side and a back side, the housing body adapted to receive a terminal fitting from the back side;

a holder adapted to engage the housing body from the front side, the holder having a temporary retention position relative to the housing body and a full retention position relative to the housing body;

a retention arm provided on one of the housing body and the holder, the retention arm having a end portion;

a temporary retention means for engaging the retention arm to retain the holder in the temporary retention position;

a full retention means for engaging the retention arm and prohibiting the holder from moving to the full retention position, wherein the full retention means includes an inclined surface portion configured to abut an inclined surface portion of the end portion and urge the end portion and retention means into a more secure engagement upon movement of the holder toward the full retention position; and a flexible arm provided on one of the housing body and the holder, the flexible arm adapted to engage the terminal fitting.

3. The electrical connection assembly as in claim 2, further including a flexible arm support provided on the other of the housing body and the holder relative to the flexible arm, the flexible arm support adapted to block flexure of the flexible arm when the terminal fitting is retained by the flexible arm and the holder is in the full retention position.

4. The electrical connection assembly as in claim 2, wherein the temporary retention means includes a temporary retention protrusion provided on the other of the housing body and the holder with respect to the retention arm, the temporary retention protrusion adapted to engage an engaging hole surface of an engaging hole in the retention arm when the holder is in the temporary retention position.

5. The electrical connection assembly as in claim 2, wherein the full retention means includes a full retention protrusion provided on the other of the housing body and the holder with respect to the retention arm, the full retention protrusion adapted to engage an engaging hole surface of an engaging hole of the retention arm when the holder is in the full retention position.

6. The electrical connection assembly as in claim 2, further including a jig insertion hole on the holder for receiving a jig adapted to move the retention arm from a position where the retention arm is engaged with one of the temporary retention means and the full retention means to a non-engaged position.

7. The electrical connection assembly as in claim 2, further including a waterproof plug provided between a terminal insertion hole in the housing body and an electric wire member extending from the terminal fitting, the waterproof plug adapted to seal a gap between the terminal insertion hole and the electric wire member.

8. The electrical connection assembly as in claim 2, further including a packing provided on the housing body to seal a connection area between the housing body and the holder.

9. An electrical connection assembly, comprising:

a housing body having a front side and a back side, the housing body adapted to receive a terminal fitting from the back side;

a holder adapted to engage the housing body from the front side, the holder having a temporary retention position relative to the housing body and a full retention position relative to the housing body;

a retention arm provided on one of the housing body and the holder, the retention arm having a end portion;

a temporary retainer disposed between the housing body and the holder, the temporary retainer adapted to engage the retention arm and retain the holder in the temporary retention position;

a full retainer disposed between the housing body and the holder, the full retainer adapted to engage the retention arm and retain the holder in the full retention position, the full retainer having a surface portion adapted to abut a surface portion of the end portion of the retention arm so as to form an engagement with the end portion when the holder is in the temporary position prohibiting the holder from moving to the full retention position.

10. The electrical connection assembly as in claim 9, wherein said surface portion of the full retainer and the surface portion of the end portion form orthogonal abutting surfaces.

11. The electrical connection assembly as in claim 9, wherein said surface portion of the full retainer and the surface portion of the end portion form inclined abutting surfaces urging the end portion and retention means into a more secure engagement upon movement of the holder toward the full retention position.

12. The electrical connection assembly as in claim 11, further including a flexible arm provided on one of the housing body and the holder, the flexible arm adapted to engage the terminal fitting.

13. The electrical connection assembly as in claim 12, further including a flexible arm support provided on the other of the housing body and the holder relative to the flexible arm, the flexible arm support adapted to block flexure of the flexible arm when the terminal fitting is retained by the flexible arm and the holder is in the full retention position.

14. The electrical connection assembly as in claim 11, wherein the temporary retainer includes a temporary retention protrusion provided on the other of the housing body and the holder with respect to the retention arm, the temporary retention protrusion adapted to engage an engaging hole surface of an engaging hole in the retention arm when the holder is in the temporary retention position.

15. The electrical connection assembly as in claim 11, wherein the full retainer includes a full retention protrusion provided on the other of the housing body and the holder with respect to the retention arm, the full retention protrusion adapted to engage an engaging hole surface of an engaging hole of the retention arm when the holder is in the full retention position.

16. The electrical connection assembly as in claim 11, further including a jig insertion hole on the holder for receiving a jig adapted to move the retention arm from a position where the retention arm is engaged with one of the temporary retainer and the full retainer to a non-engaged position.

17. The electrical connection assembly as in claim 11, further including a waterproof plug provided between a terminal insertion hole in the housing body and an electric wire member extending from a terminal fitting, the waterproof plug adapted to seal a gap between the terminal insertion hole and the electric wire member.

18. The electrical connection assembly as in claim 11, further including a packing provided on the housing body to seal a connection area between the housing body and the holder.

* * * * *